US005209003A

United States Patent [19]

Maxfield et al.

[11] Patent Number: 5,209,003

[45] Date of Patent: May 11, 1993

[54] SNOW BLOWER AUGERS AND IMPELLERS

[75] Inventors: LeRoy Maxfield; Donald H. Verhoff; David R. Church, all of Oshkosh, Wis.

[73] Assignee: Oshkosh Truck Corporation, Oshkosh, Wis.

[21] Appl. No.: 787,493

[22] Filed: Nov. 4, 1991

Related U.S. Application Data

[63] Continuation-in-part of Ser. No. 732,377, Jul. 18, 1991, abandoned.

[51] Int. Cl.[5] ..... E01H 5/09

[52] U.S. Cl. ..... 37/252; 37/249; 37/259; 37/258

[58] Field of Search ..... 37/197, 248, 249, 252, 37/257, 258, 259, 251

[56] References Cited

U.S. PATENT DOCUMENTS

| | | | |
|---|---|---|---|
| 4,261,116 | 4/1981 | Kahlbacher | 37/248 |
| 4,367,603 | 1/1983 | Schlapman | 37/248 X |
| 4,391,052 | 7/1983 | Guy, Jr. | 37/251 X |

FOREIGN PATENT DOCUMENTS

| | | | |
|---|---|---|---|
| 623916 | 8/1978 | U.S.S.R. | 37/249 |

*Primary Examiner*—Dennis L. Taylor
*Assistant Examiner*—J. Russell McBee
*Attorney, Agent, or Firm*—Baker & McKenzie

[57] ABSTRACT

An auger type snow blower assembly having an auger with two sets of rotating ribbon spokes which transfer snow from the auger to an impeller inlet located at the mid-portion of the auger assembly, the ribbon spokes terminating a substantial distance short of the center of the auger assembly whereby snow lying directly in the center of the path of the auger assembly may move directly to the impeller inlet without contact with the ribbons. Further, the ribbons revolve around a generally cone-shaped structure at the ends of the auger assembly whereby the ribbons and the stationary cones cooperate to impel snow entering the auger assembly toward the impeller inlet. The auger assembly further includes a bi-directional, variable speed hydraulic drive system for the ribbon system consisting of variable forward speeds and reverse speeds, the forward speeds including a low ribbon speed high torque speed, and a high ribbon speed low torque speed, together with pressure relief valves to avoid the use of shear pins. The impeller is lined with UHMW polyethylene plastic to provide very low friction between the snow and the components of the impeller which come in contact with the snow.

11 Claims, 6 Drawing Sheets

SNOW BLOWER AUGERS AND IMPELLERS

This application is a continuation-in-part of prior copending application Ser. No. 07/732,377 filed Jul. 8, 1991, and now abandoned.

This invention relates to snow displacement equipment and particularly to apparatus for removing snow which is specially adapted to be incorporated in the multipurpose plow type of snow removal equipment, and a method of displacing snow by the auger and impeller system.

BACKGROUND OF THE INVENTION

Commercial snow removal equipment includes snow blowers which utilize an auger to transfer snow to an impeller from whence it is directed in a stream away from the plowing area and, also, blade-type plows which are characterized by one or two plow-type blades mounted on the front end of a tractor vehicle which pushes snow to one or both sides of its path of movement. The auger and impeller system frequently requires a blower engine of high horsepower whereas the traction power requirements are modest. In the plow or displacement type system there is no need for a second snow blower engine but the traction power must be very substantial because the traction engine must provide not only motive power to move the equipment but also the power needed to cut through and push aside heavy snow masses.

In recent years the multipurpose plow concept has evolved. The tractor vehicle, since it may be used for tasks other than snow removal, of necessity has an engine which is more powerful than the traction engine required in an auger and impeller type system. Thus, when the tractor is used with an auger and impeller type snow removal system, the traction vehicle is, in effect, over powered which is inefficient and uneconomical.

Over and beyond the adaptation of the auger and impeller type system to the multipurpose plow concept, the workers in the art have recognized certain inherent drawbacks in the auger and impeller type system.

One problem is the need to increase the efficiency of the transfer of snow from the auger flights, or ribbons, to the impeller inlet. At the present time a substantial quantity of the snow which reaches the auger is churned and thus has an undesirably long dwell time in the blower prior to entering the impeller. Forward spillage of snow is also a problem since the churning of the snow in the traction path causes some portion of the snow which has been gathered to be thrown forward and "handled" many times before actually entering the impeller and thereby leaving the system.

In this connection, it has been observed that in the conventional auger-impeller type system in which the auger extends the full width of the blower head, considerable power is wasted in the mid-section of the blower because snow which is directly aligned with the impeller opening is forced to go through the tumbling action derived from the ribbon before entering the impeller opening. A particle of snow which is aligned with the impeller opening as the blower advances, and thus may have only three feet or less to move in a direct line to the impeller opening, often may traverse a path which is a multiple of times longer than the direct line path due to the rotation and other side movements applied to it by the continuously rotating ribbon.

Another need is to increase the low efficiency in an auger-impeller type system due to friction between the snow and the interior of the impeller housing as the snow is swept along an arc within the impeller housing and then forced upwardly in the impeller chute or outlet. Further, the shearing action between the impeller blades and the housing also causes snow leakage from the system. And there is a continual need to increase the velocity of the snow as it exits the impeller so as to have a cleaner stream with an improved cast distance and a less scattered pattern.

SUMMARY OF THE INVENTION

The invention is an auger-impeller type snow blower which has improved performance, efficiency, ease of use and safety as contrasted to current constructions and, in addition, is particularly applicable to the multipurpose plow concept. In general, the invention overcomes the problems mentioned above in an economical and efficient manner.

BRIEF DESCRIPTION OF THE INVENTION

The invention is illustrated more or less diagrammatically in the accompanying drawing wherein FIG. 1 is an end elevation of the snow blower of this invention;

SPECIFIC DESCRIPTION OF THE INVENTION

Figure 1:
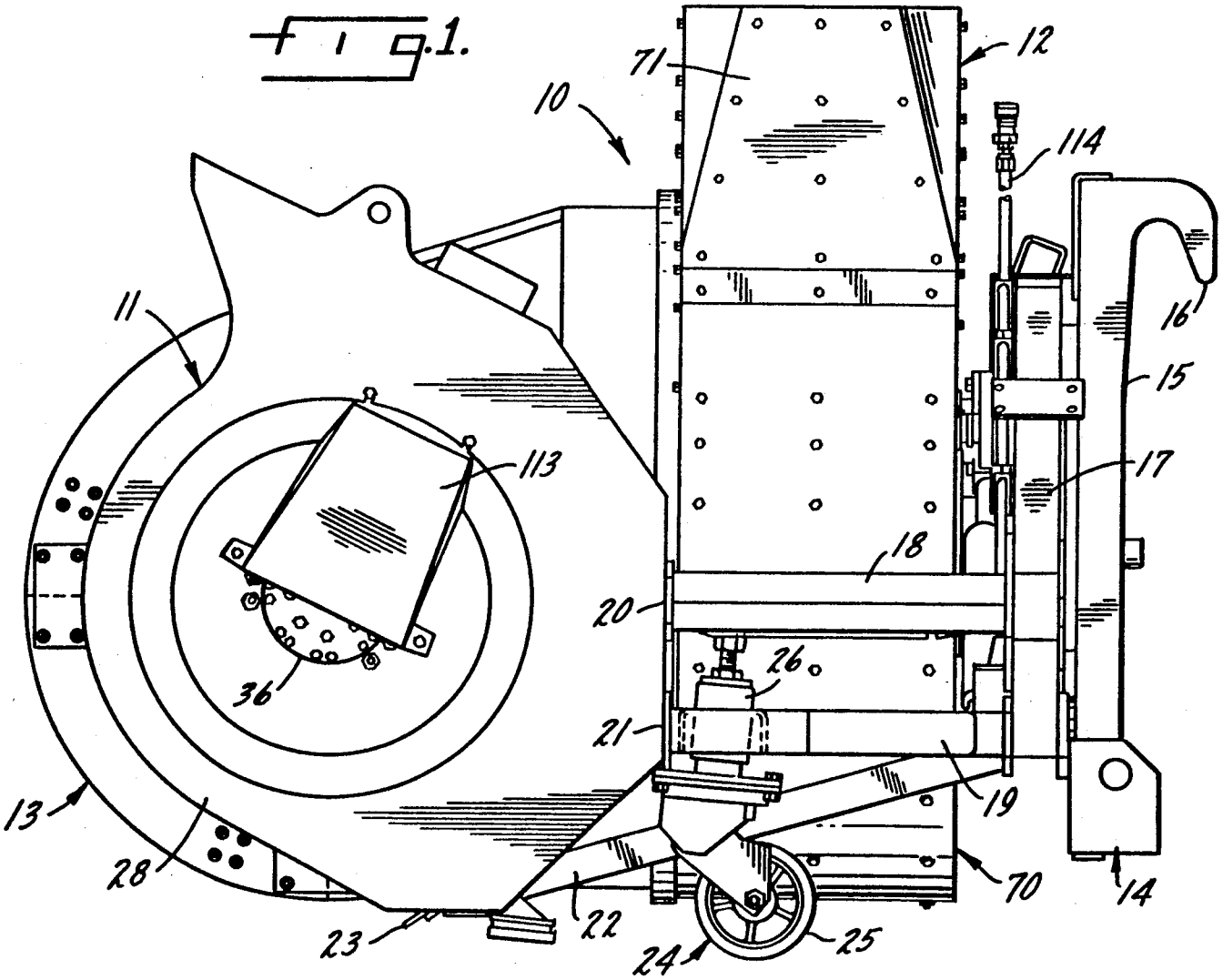

Like reference numerals will be used to refer to like parts from Figure to Figure throughout the following description of the drawing.

Figure 2:
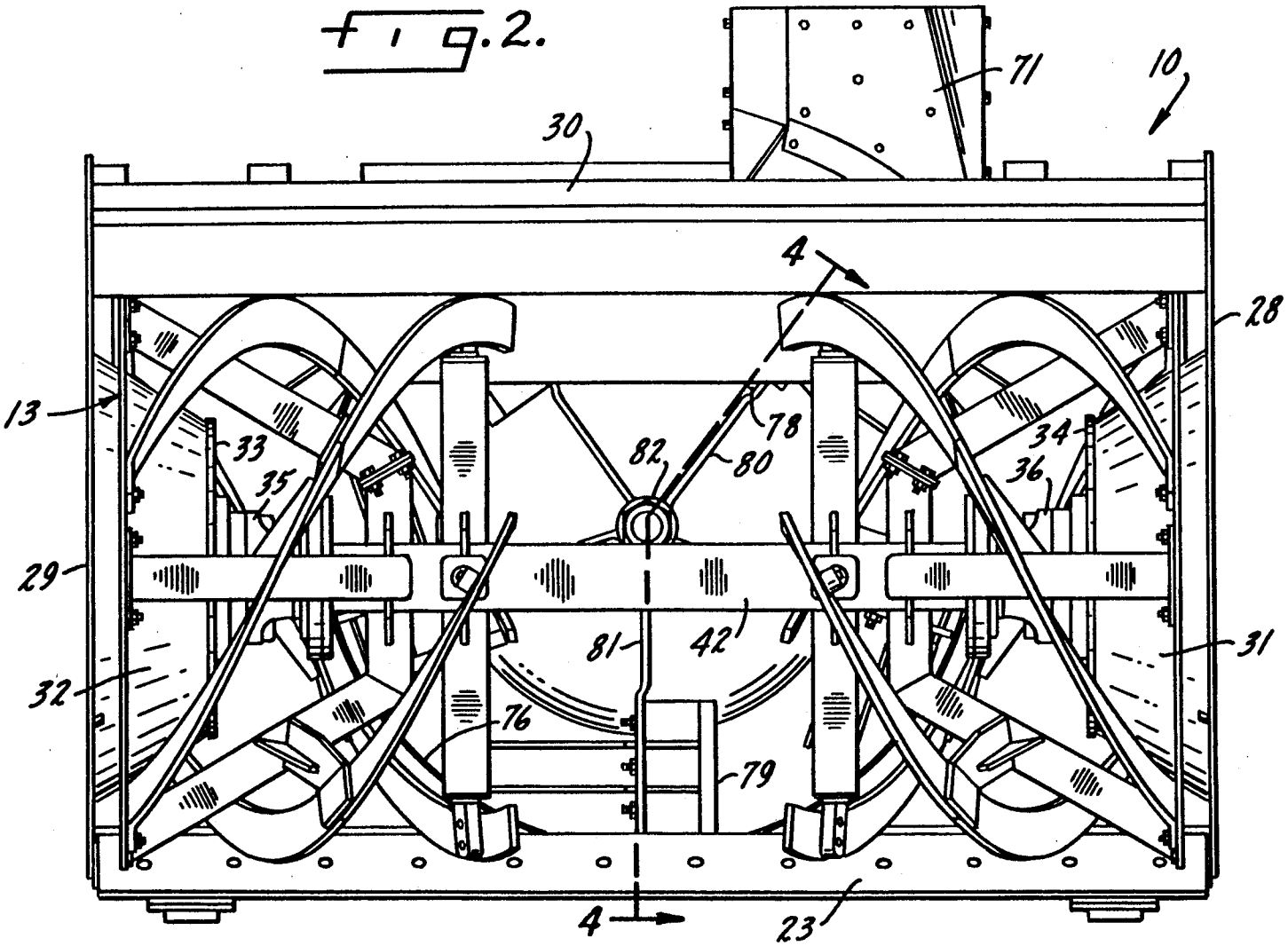
FIG. 2 is a front view.

The auger and impeller snow removal system of this invention is indicated generally at 10 in FIGS. 1 and 2. The system includes an auger assembly, indicated generally at 11, and an impeller assembly indicated generally at 12. The system is more usually referred to as a blower and this term will be used frequently herein.

The auger assembly 11 includes an auger, indicated generally at 13, which is carried by a supporting framework indicated generally at 14. The framework 14 includes a hook plate weldment 15 which is adapted to be mounted to a vehicle, such as an off highway truck used for snow removal, by hooks, one of which is indicated at 16. Vertical support members, the details of which are not essential to an understanding of the invention, are indicated at 17, said vertical support members being bolted or otherwise suitably secured to hook plate weldment 15. Support arms extend forwardly from the vertical support framework, two of which are indicated at 18 and 19. The forward ends of arms 18, 19 are secured to auger 13 by mounting plates 20, 21. An angled reinforcing strut is indicated at 22 and is connected at its lower end to the scraper blade 23, see FIG. 2, of the auger housing. Arm 19 carries a caster wheel assembly, indicated generally at 24, the caster wheel assembly including a wheel 25 and a wheel height adjustment member 26 carried by arm 19.

Scraper blade 23 forms, in effect, the bottom of an auger housing which includes left and right side plates 28, 29 and top portion 30, see FIG. 2. In this description, left and right will be used in reference to an observer looking in the direction of travel, as would be the viewing position of a driver of a traction vehicle.

A pair of mounting and driving cones are indicated at 31, 32. In this instance these cones are essentially trapezoidal in shape as can be best seen in FIG. 2. The base of the cones are welded or otherwise suitably secured to the left and right side plates 28, 29 of the auger housing. The inner ends of each cone, that is, the end closest to the center of the auger assembly, terminate in a mounting plate, and are indicated at 33, 34. In this instance a hydraulic motor is mounted to each mounting plate 33, 34, the hydraulic motors being indicated at 35, 36, see also FIG. 5. The left end of motor 36 terminates in a flange 37 which is connected by bolts 38, 39 to an auger adaptor plate 40.

Figure 5:
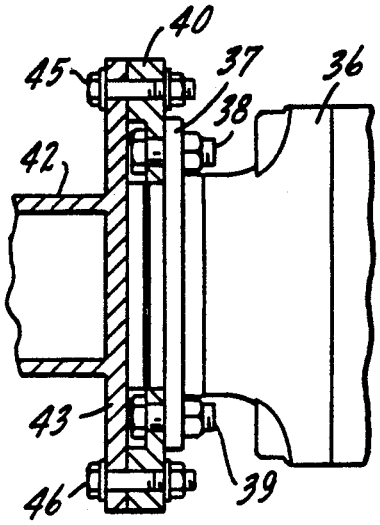
FIG. 5 is a detail view to an enlarged scale of the driving connection from the power system to the auger.

The auger 13 includes a hollow shaft 42, see also FIG. 5, which terminates in mounting plates 43, 44. The connection of the left end of auger shaft 42 by auger shaft mounting plate 43 to the mounting flange 37 of the framework 14 is best seen in FIG. 5, using bolts 45, 46.

Auger shaft 42 carries a pair of spider cones, one at each end, indicated generally at 47, 48. Left spider cone 47 includes four equidistantly spaced spokes, three of which are indicated at 49, 50 and 51. Spokes 49, 51 are welded or bolted to radial arms 52, 53 which in turn are fast with shaft 42. Spoke 50 is also secured to shaft 42. The outside ends of all spokes are bolted to either left curb ring 54 or right curb ring 55. Each of the curb rings is continuous and may, if desired, be formed from four 90° sections, the meeting ends of which are secured to one another by support plates 56, 57, 58.

A plurality, in this instance four, ribbon flights are mounted to the auger 13 at each end of shaft 42, and are indicated at 59, 60, 61, 62. Since the ribbon flights at each end of auger shaft 42 are identical except reversed in position, a description of the ribbon flights at the left end of auger 13 will suffice for both.

Ribbon 59, for example, is secured at its left, outer end to left curb ring 54 by bolts 63 and ring support plate 58. The right or inner end of flight 59 is connected to strut 64 by bolts 65. The strut 64, which in this instance is square, is in turn welded at its radially inner end to auger shaft 42. A ribbon support plate is indicated at 66 and a ribbon support gusset at 67, the plate and gusset forming a brace between ribbon 62 and spoke 51 to provide rigidity to the ribbon.

Figure 3:
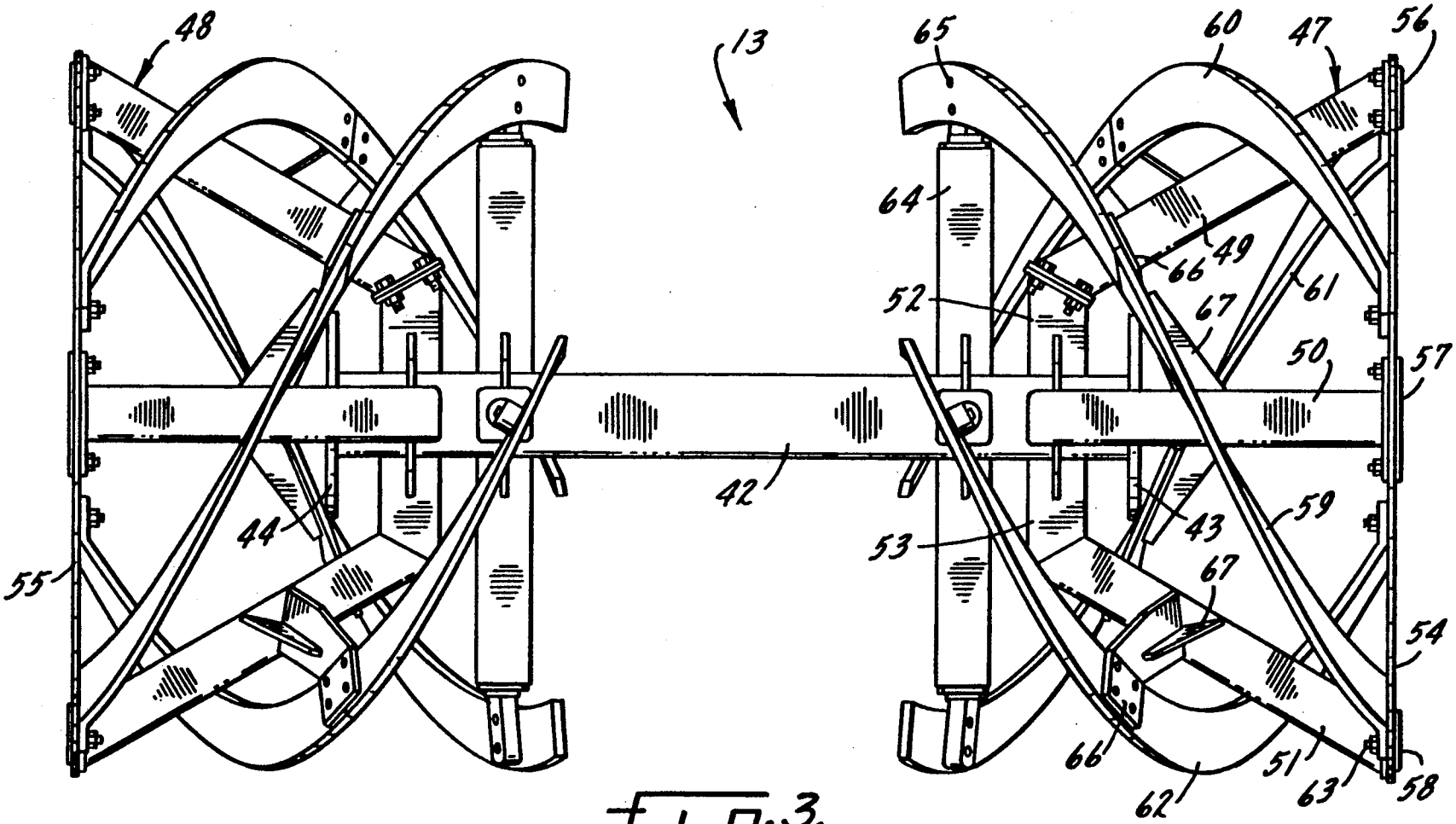
FIG. 3 is an elevation of the auger assembly.

As can be readily seen from FIGS. 2 and 3, the inner ends of the ribbons on each side of the auger terminate a substantial distance from one another, thereby providing an open space which contains only the shaft 42, all for a purpose which will be described hereafter.

Figure 4:
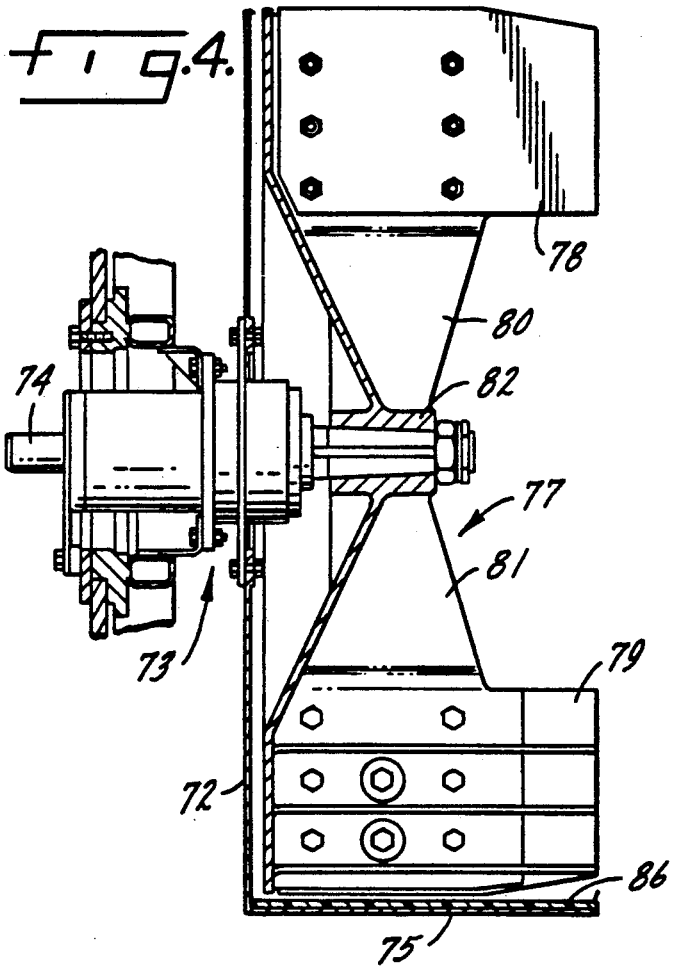
FIG. 4 is a section through the impeller and its mounting structure taken substantially along line 4—4 of FIG. 2.

The impeller assembly 12 includes an impeller housing 70 which terminates in a discharge chute 71. The impeller housing includes a circular back wall 72, see FIGS. 4 and 6, having a central aperture which receives a drive unit 73, which drive unit includes a drive shaft 74, see FIG. 4. A generally circular enclosing wall is indicated at 75, the enclosing wall extending approximately 315° around the back wall, but opening into the discharge chute 71 over approximately 45° of its circumference. The outlet from the auger is indicated at 76 in FIG. 2. An impeller fan is indicated generally at 77 in FIG. 4, the fan consisting of a plurality of vanes 78, 79 which are located at the radially outer extension of vane arms 80, 81 respectively. The inner ends of vane arms 80, 81 are fast with a hub 82 which rotates with the drive shaft 74 of drive unit 73.

Figure 7:
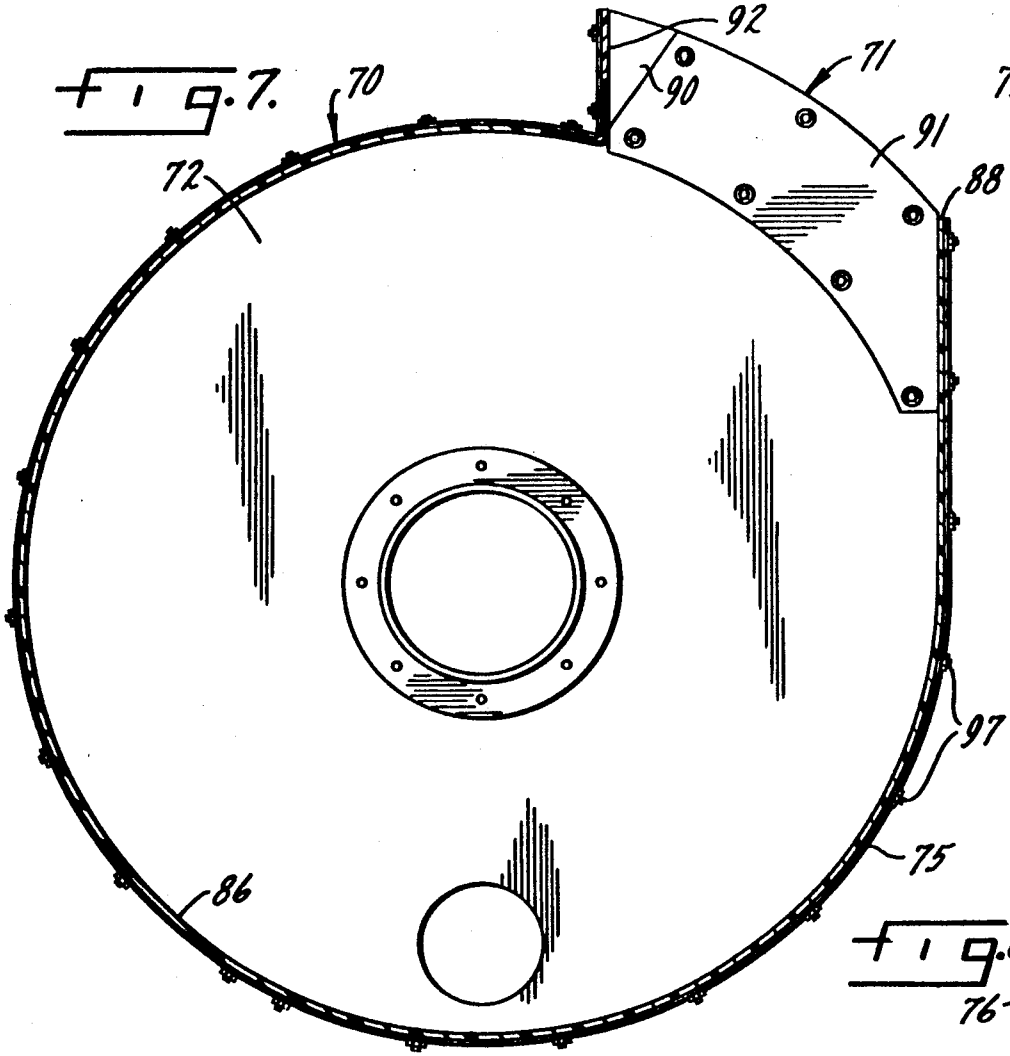
FIG. 7 is a view taken substantially along the line 7—7 of FIG. 6.

The efficiency of the impeller is increased by an ultra high molecular weight polyethylene plastic liner assembly 86 for the impeller housing, said liner assembly 86 being sometimes hereafter referred to as a UHMW liner. While the preferred embodiment employs ultra high molecular weight polyethylene for the liner 86, the use of other plastic material is foreseeable. The UHMW liner assembly includes a wide UHMW strip 86 which lines the interior surface of enclosing wall or housing 75, the interior or rear edge of UHMW strip 86 butting against the back wall to form a tight joint therebetween. As best seen in FIG. 7, the housing liner strip 86 extends the full circumference and width of the enclosing wall 75. The left end of liner strip 86 is indicated at 88, see FIG. 7, and extends generally upwardly so as to form a lining for a portion of chute 71. The chute includes an extension 90 of back wall 72 and a pair of arcuate UHMW extension liners, one of which is indicated at 91. A vertical section of the UHMW liner assembly 86 which is located parallel to the axis of drive shaft 74 is indicated at 92.

The UHMW liner sections which form the liner assembly are secured to their abutting sheet metal housing structures 72, 75, by countersunk bolts and nuts 97.

Figure 6:
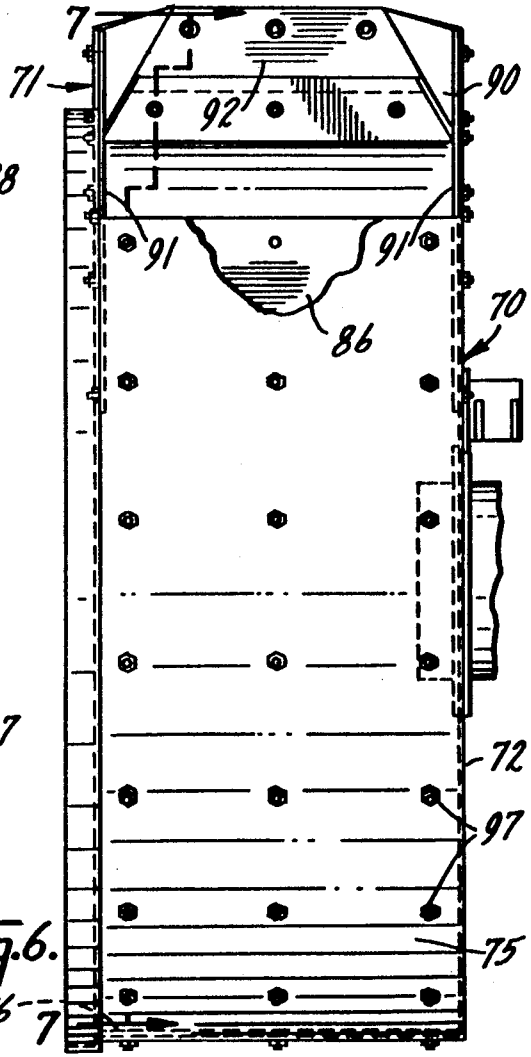
FIG. 6 is a right side view of the impeller housing assembly.

From a consideration of FIGS. 6 and 7 it will thus be appreciated that the entire active interior surface area of the impeller, including the discharge chute, presents a UHMW surface to the moving snow mass in contact with the containing walls of the impeller assembly.

Figure 8:
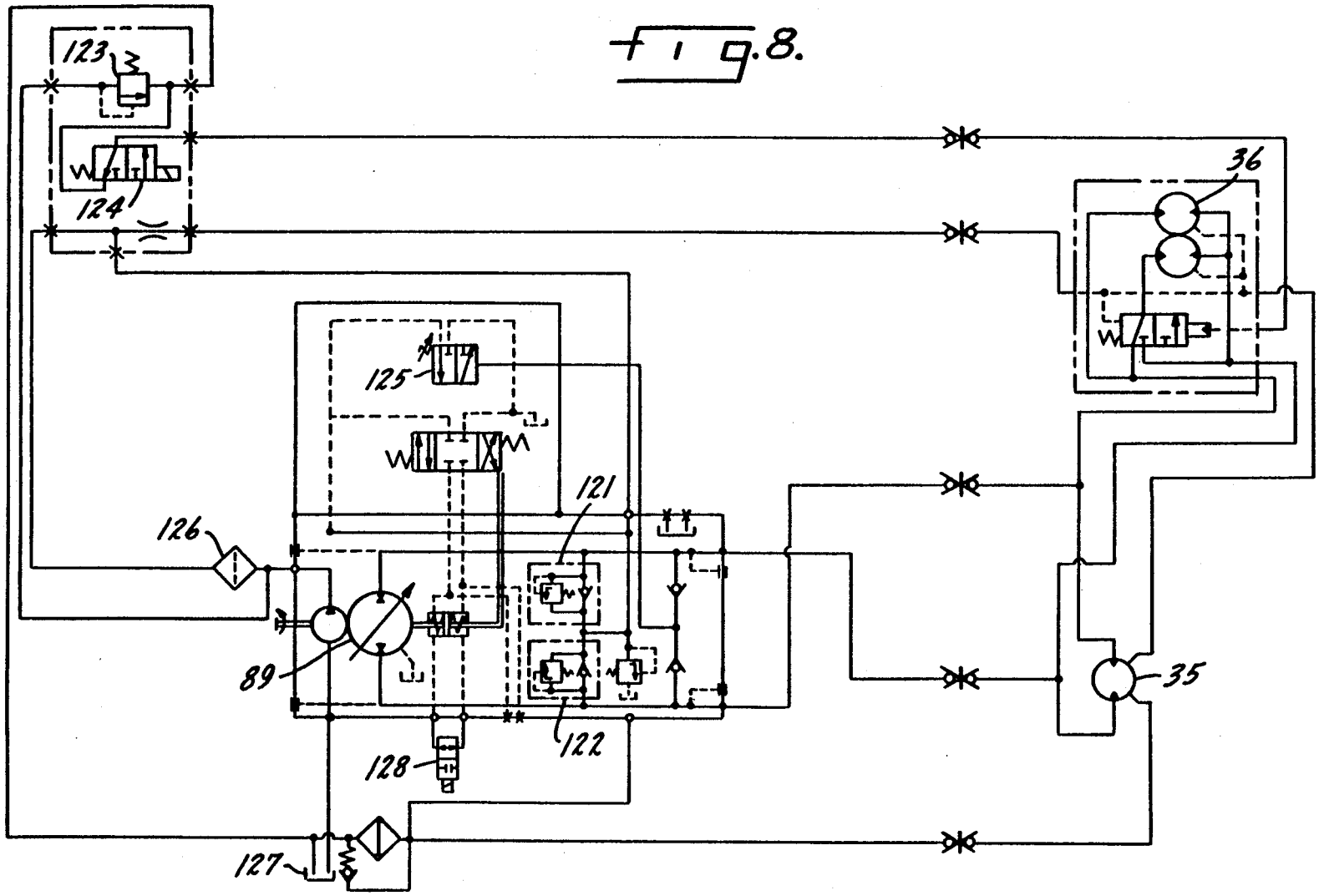
FIG. 8 is a schematic view of the hydraulically driven variable speed bi-directional ribbon drive.

A hydraulically driven variable speed bi-directional ribbon drive is indicated schematically in FIG. 8. This system includes motors 35, 36 which are also shown in FIG. 1. A hydraulic tube guard is indicated at 113 and a quick disconnect hydraulic line is indicated at 114 FIG. 1. A further description of the hydraulic drive system will appear in the description of the use and operation of the system.

In operation a vehicle, such as an off highway truck to which the auger-impeller snow removal system 10 has been connected by hooks 16 of hook plate weldment 15, advances in a forward or leftward direction as viewed in FIG. 1. As the rigid frame of the auger assembly 11 contacts the piled or drifted snow, the rotating ribbons 59–62 will contact the snow and move it toward the impeller entrance indicated at 76. Impeller vanes 78, 79 of impeller fan 77 will in turn move the snow upwardly through impeller discharge chute 71 and out of the system in a clean stream. In the course of operation the following handling action of the snow occurs.

The primary function of the blower's ribbon is to transfer snow to the impeller inlet. The concept of stationary side cones 47, 48 combined with sweeping outer ribbon spokes 59–62 facilitate this function by forcing the snow into the volume swept by the helical ribbon flights which in turn drive the snow directly into the impeller inlet 76. The side cones 31, 32 also serve to funnel the snow inward reducing side spillage. Inefficiencies due to the snow entering the central volume of the ribbon and being churned is minimized and forward spillage of snow is markedly reduced.

A snow removal vehicle dedicated solely to blower operation requires only moderate traction engine power with most of the snow removal power coming from the blower engine. However, with the multipurpose plow concept, a more powerful traction engine is required for the traction vehicle. This invention takes advantage of this additional available traction horsepower, thereby reducing the power required from the blower engine.

The exaggerated, open center design of the ribbon and the large, open, close-to-the-ground impeller inlet 76 allows snow laying in the path of the impeller inlet to be pushed directly into the impeller by the forward motion of the vehicle alone. Were the ribbon to continuously span the width of the head, considerable power would be wasted within the mid-section, reducing the volumetric efficiency of the system. Thus, the open center concept allows some of the work otherwise performed by the ribbon (powered by the blower engine) to be shifted to the traction engine. The open center ribbon is also very efficient at moving the snow to the center and depositing it in front of the impeller 12. By contrast, full length ribbons which extend completely from end to end of the auger generally throw a large amount of snow forward which causes the snow to be "handled" many times before reaching the impeller.

Snow masses entering the impeller through auger outlet or impeller inlet 76 come in contact with the UHMW liner assembly of the impeller assembly. All surfaces which the snow could contact are composed of the UHMW material whereby the friction is reduced between the snow and the interior of the housing unit.

Wet, high density and sticky or deep hard packed snow conditions tend to jam blower ribbons. Frequently this type of stoppage is further complicated by breakage of shear pins required to protect the ribbon drive line. Clearing the snow by hand and replacing the shear pins is a time consuming, tiring, frustrating and potentially dangerous operation. This invention incorporates several features that eliminate these inconveniences.

The system is hydraulically driven and has the ability to drive the ribbon at variable speeds, fast to slow, in the forward direction. There is also a neutral mode. The system is protected from mechanical failure due to jamming by a hydraulic pressure relief.

The forward speeds allow the operator to select fast ribbon speed for high speed clearing operation, and slow ribbon speed (and higher torque) for low speed clearing required in deep and heavy snow conditions. The low speed/high torque mode enables the ribbon to overcome the resistive forces of deep and heavy or hard packed snow reducing the possibility of jamming.

In the rare event that the ribbon does become jammed, the operator can back the vehicle away from the snow and reverse the ribbon rotation. In most instances, this will immediately clear the ribbon and the operation can continue with only momentary delay and minimal effort. If this action is not immediately successful, the operator is able to repeatedly shift ribbon direction from forward to reverse furthering the chances of clearing the ribbon without manual intervention. A more detailed description of the ribbon drive follows.

The auger drive consists of a variable displacement hydraulic pump 89, a manual control lever to control the pump displacement, motors 35, 36, pressure relief valves 121, 122, control valves 123, 124, a filter 126, and a reservoir 127.

The hydraulic pump 89 is driven off the PTO drive of the auxiliary or main vehicle engine. The pump drives the motors 35, 36 via a closed loop hydraulic system. The hydraulic drive system is protected from excessive torque conditions by relief valves 121, 122 and a pressure override (POR) 125 control that is incorporated into the pump 89. The relief valves 121, 122 and POR 125 eliminate the need for shear pins in the auger drive system by allowing the auger 13 to be held stationary with the control lever in any position without damage to the system. Shear pins are difficult to replace and shear often in high torque conditions.

The motors 35, 36 are mounted to the cones, as shown in FIG. 2. One or two motors can be used, depending on the torque required. If only one motor is used, the other motor would be replaced by a bearing. The auger 13 is located between the motors and is bolted to the motor drive flanges 37 via an adaptor plate 40 as shown in FIG. 5. This mounting configuration allows the auger 13 to be removed from the blower without removing the motors 35, 36 and their associated hydraulic lines.

The impeller clutch interlock valve 128 is a safety feature which prevents the pump 89 from providing hydraulic power to the motors 35, 36 when the clutch for the impeller drive is disengaged.

With the control lever in the neutral position, the pump 89 has zero displacement. Therefor there is no output from the pump 89 to the motors 35, 36, and the auger 13 does not rotate.

Moving the control lever in the forward direction causes the pump displacement to increase from zero, which causes oil to flow to the motors 35, 36, increasing their rotational speed in the forward direction. When a preset control lever position is reached the two speed valve 124 shifts, which decreases the motor displacement, resulting in less torque to the auger but a higher auger rotational speed. In high vehicle speed blowing operations, where the snow is light and/or shallow, less auger torque is required to feed the impeller. However, a higher auger rotational speed is required to keep the tangential speed at the outer edge of the ribbon flights at or above the ground speed to prevent build up of snow in front of the blower. This system provides the higher speed necessary without excess torque, which is a more efficient use of the available power.

Moving the control lever in the reverse direction causes the pump displacement to increase from zero, with flow to the motors 35, 36 reversed from the forward direction. This turns the motors, which turn the auger 13, in the reverse direction. The reverse rotation allows the auger to clear itself if plugged by debris, large ice chunks, etc. The operator can clear a plugged auger without leaving the cab by reversing the ribbon direction, eliminating the strenuous and potentially dangerous task of shovelling out the auger by hand and replacing shear pins.

Although a specific embodiment of the invention has been illustrated and described it will at once be apparent that modifications may be made within the spirit and scope of the invention. Hence it is intended that the scope of the invention be limited solely by the scope of the hereafter appended claims when interpreted in light of the relevant prior art and not solely by the foregoing description.

I claim:

1. In a snow blower auger assembly having a front opening defined by a rear wall and two end wall means which project forwardly of the rear wall and into which snow enters as the assembly moves forwardly, a set of ribbon spokes extending inwardly from each end wall means toward the center of the auger assembly, each set of ribbon spokes terminating short of the center of the auger assembly, means for providing an open central region between the inner terminal ends of the sets of ribbon spokes, said central region being unobstructed by the sets of ribbon spokes, wherein at least a portion of the snow aligned with the said central region of the auger assembly enters said central region without deflection in any direction transverse to the direction of advance of the auger assembly into the snow, said means for providing including:

an impeller intake located in the center of the rear wall;

said impeller intake being located behind the sweep of the sets of ribbons.

2. The auger assembly of claim 1 further including a generally cone-shaped structure located within the sweep of each set of ribbon spokes at each end portion of the auger assembly, whereby each set of ribbon spokes and its associated cone-shaped structure function to impart movement of snow within the sweep of the spokes toward the center of the auger assembly.

3. The auger assembly of claim 2 further characterized in that the cone-shaped structure are stationary.

4. The auger assembly of claim 1 further characterized in that said sets of ribbon spokes are mounted on a common sheet means which extends from end wall means to end wall means.

5. The auger assembly of claim 1 further characterized in that the open central region between the inner terminal ends of the sets of ribbon spokes extends about one-third of the distance between the outer ends of the sets of ribbon spokes.

6. The auger assembly of claim 1 further characterized in that the bottom of the impeller opening is at substantially the same elevation as the bottom of the sweep of the ribbon spokes.

7. In a snow blower auger assembly having a front opening defined by a rear wall and two end wall means which project forwardly of the rear wall and into which snow enters as the assembly moves forwardly, a set of ribbon spokes extending inwardly from each end wall means toward the center of the assembly, each set of ribbon spokes terminating short of the center of the auger assembly, means for providing an open, unobstructed central region between the inward terminal ends of the sets of ribbon spokes, wherein snow aligned with the said central region of the auger assembly enters said central region without deflection in any direction transverse to the direction of advance of the auger assembly into the snow, said means for providing including:

an impeller assembly having an intake located in the center of the rear wall;

said impeller intake being located behind the sweep of the set of ribbons, said impeller assembly including a lining of ultra high molecular weight plastic having a very low co-efficient of friction with respect to snow, said lining covering substantially all portion of said impeller assembly which make contact with snow as snow moves through the impeller.

8. The auger assembly of claim 7 further including a generally cone-shaped structure located within the sweep of each set of ribbon spokes located at each end portion of the auger assembly, whereby each set of ribbon spokes and its associated cone-shaped structure function to impart movement of snow within the sweep of the spokes toward the center of the auger assembly.

9. The auger assembly of claim 8 further characterized in that the cone-shaped structures are stationary.

10. The snow blower auger assembly of claim 7 further characterized in that said sets of ribbon spokes are mounted on common shaft means which extend from end wall means to end wall means.

11. The snow blower auger assembly of claim 7 further characterized in that the open central region between the inner terminal ends of the sets of ribbon spokes extends about one-third of the distance between the outer ends of the sets of ribbon spokes.

* * * * *